US005784942A

United States Patent [19]

Jones

[11] Patent Number: 5,784,942

[45] Date of Patent: Jul. 28, 1998

[54] SPIRAL POTATO SLICING APPARATUS AND METHOD

[76] Inventor: Birdsall L. Jones, P.O. Box 8541, Coburg, Oreg. 97408

[21] Appl. No.: 753,218

[22] Filed: Nov. 21, 1996

[51] Int. Cl.[6] ..... B26D 1/02

[52] U.S. Cl. ..... 83/856; 83/932; 83/733

[58] Field of Search ..... 83/932, 733, 880, 83/425.1, 856, 435.15; D7/693

[56] References Cited

U.S. PATENT DOCUMENTS

| | | | |
|---|---|---|---|
| 2,299,092 | 10/1942 | Johnson | 83/425.1 |
| 2,341,582 | 2/1944 | Turner | 83/425.1 |
| 2,464,993 | 3/1949 | Ross | 83/425.1 X |
| 2,508,868 | 5/1950 | Ross | 83/425.1 X |
| 3,211,202 | 10/1965 | Mason | 83/425.1 X |
| 3,706,202 | 12/1972 | Basa | 74/661 X |
| 3,874,259 | 4/1975 | Chambos et al. | 83/733 X |
| 3,952,621 | 4/1976 | Chambos | 83/733 |
| 4,569,266 | 2/1986 | Ando | 83/733 X |
| 5,179,881 | 1/1993 | Frey et al. | 83/402 X |
| 5,275,092 | 1/1994 | Fauteux | 99/407 |

*Primary Examiner*—Maurina T. Rachuba
*Attorney, Agent, or Firm*—David S. Alavi

[57] ABSTRACT

A spiral potato slicer is described herein comprising: a base; a carriage mounted on the base which may slide longitudinally along the base; a motor mounted on the carriage; a longitudinal threaded shaft connected to the motor, rotated by the motor, having a thread pitch of greater than about ten threads per inch, and having at least one stripped segment for limiting longitudinal motion of the shaft during rotation; a threaded shaft-engaging means mounted on the base and requiring a force applied by a user to maintain engagement of the threaded shaft; potato engaging means mounted on the second end of the shaft; and a radial cutting blade mounted on the base near the end of the base closest to the potato engaging means on the shaft. The combination of rotary and longitudinal motion produced by rotation of the threaded shaft results in slicing of the potato into a substantially continuous spiral sheet as the potato encounters the radial cutting blade. The pitch of the threaded shaft may be greater than about ten threads per inch so that the resulting substantially continuous spiral potato slice yields a spiral potato chip upon deep frying.

14 Claims, 2 Drawing Sheets

SPIRAL POTATO SLICING APPARATUS AND METHOD

FIELD OF THE INVENTION

The field of the present invention relates to vegetable slicing. In particular, a spiral potato slicer and a spiral potato slicing method are described herein for cutting continuous thin spiral slices of potato preparatory to deep frying the same. Such a potato slicer is particularly useful for restaurant operation.

BACKGROUND

Spiral potato slicing apparatus are described in U.S. Pat. No. 2,508,868 to Ross, U.S. Pat. No. 3,874,259 to Chambos et al, and U.S. Pat. No. 3,952,621 to Chambos, each of which patents are hereby incorporated by reference as if fully set forth herein. The apparatus described in these patents are used to produce so called curly fries, or spiral fries. The Ross patent describes a spiral potato slicer wherein a potato to be sliced is mounted onto the end of a threaded shaft and the potato is advanced toward a stationary cutter assembly by rotation of the shaft by means of a hand crank. The stationary cutter assembly consists of a plurality of longitudinal scoring blades which produce circular cuts in the end of the potato, and a single radial blade for slicing off the circular scored sections of the potato. In this way continuous spiral potato slices are produced having a substantially square transverse cross section which may then be deep fried to produce spiral, or curly, fries. The transverse dimensions of the resulting fries are determined by the spacing of the scoring blades and the pitch of the threads of the shaft.

The apparatus described in the Chambos patents have a cutter assembly substantially similar to that in the Ross patent. The potato is mounted on the shaft of a motor which rotates the potato. The motor/potato holder is mounted on a carriage thereby allowing the potato to be advanced manually into the stationary cutter assembly. The transverse dimensions of the resulting fries are determined by the spacing of the longitudinal scoring blades and the rate at which the potato is advanced into the stationary cutter assembly.

The apparatus described in the patents cited hereinabove are suitable for producing spiral, or curly, fries. They are not suitable for producing spiral potato chips. There is a general lack of safety features in the previous motor-driven apparatus. There is nothing to prevent advancement of the potato holding means into the cutter assembly while it is rotating. The motor-driven apparatus requires a user to mount a potato, depress a trigger to activate the motor, and advance the carriage carrying the motor simultaneously. This may be awkward and potentially hazardous for the user. The user may also be exposed to and potentially injured by flying chunks of potato if the potato becomes disengaged from the apparatus during slicing. Such flying potato debris is also messy.

SUMMARY OF THE INVENTION

Certain aspects of the present invention may overcome aforementioned drawbacks of the previous art and advance the state-of-the-art of potato slicers and potato slicing methods, and in addition may meet one or more of the following objects:

To provide a spiral potato slicer which produces thin spiral slices of potato which when deep fried yield spiral potato chips;

To provide a method for producing thin spiral slices of potato which when deep fried yield spiral potato chips;

To provide a spiral potato slicer wherein a potato is mounted onto the end of a threaded shaft which is rotated by a motor thereby advancing the potato into a stationary radial cutting blade;

To provide a spiral potato slicer wherein a force applied by a user is required to maintain engagement of the threaded shaft thereby causing the motor to advance a potato into the cutting blade;

To provide a spiral potato slicer wherein the threads are stripped from the threaded shaft at each end of its safe range of motion, thereby preventing collision of rotating potato engaging means attached thereto with the cutting blade or other parts of the potato slicer;

To provide a spiral potato slicer wherein the speed of the motor is variable and controlled by a foot pedal, thereby freeing a user's hands; and To provide a spiral potato slicer having a housing to contain flying chunks of potato which may be ejected when a potato becomes disengaged during slicing.

One or more of these objects may be achieved in a preferred embodiment of a spiral potato slicer according to the present invention, comprising: a base; a carriage mounted on the base which may slide longitudinally along said base; a motor mounted on the carriage; a longitudinal threaded shaft connected to the motor, rotated by the motor, having a thread pitch of greater than about ten threads per inch, and having at least one stripped segment for limiting longitudinal motion of the shaft during rotation; a threaded shaft-engaging means mounted on the base and requiring a force applied by a user to maintain engagement of the threaded shaft; potato engaging means mounted on a second end of the shaft; and a radial cutting blade mounted on the base near the end of the base closest to the potato engaging means on the shaft and extending radially from an axis defined by the shaft. A potato to be sliced is mounted onto the end of the threaded shaft, the potato, shaft and motor are slid toward the cutting blade, and the threaded shaft is engaged. The motor is then activated, thereby rotating the threaded shaft and potato mounted thereon and producing concomitant longitudinal motion of the carriage, motor, threaded shaft and potato toward the radial cutting blade. The combination of rotary and longitudinal motion produced by rotation of the threaded shaft results in slicing of the potato into a substantially continuous spiral sheet as the potato encounters the radial cutting blade.

In order to produce spiral potato slices thin enough to yield potato chips upon deep frying, the pitch of the threaded shaft must be greater than about 10 threads per inch. A spring loaded lever with a handle and a threaded portion may be employed for engaging the threaded shaft, thereby requiring a force applied by a user to engage the threaded shaft and cause longitudinal motion of the carriage, motor, threaded shaft, and potato toward the cutting blade as the shaft is rotated by the motor. The shaft may have one or more stripped segments which do not engage the threaded portion of the shaft engaging means, thereby limiting longitudinal motion of the carriage, motor, threaded shaft, and potato toward the cutting blade as the shaft is rotated by the motor. A foot pedal may be used to activate the motor and control its speed, thereby freeing both of a user's hands for positioning a potato for slicing and for maintaining engagement of the threaded shaft. The entire potato slicer may be enclosed by a housing enclosing the carriage, motor, threaded shaft, potato, and cutting blade. The handle of the spring loaded lever for engaging the threaded shaft may protrude from the housing thereby allowing actuation by the user, and an opening in the housing may be provided for inserting and mounting the potato onto the end of the shaft, but may be small enough so that any flying chunks of potato are likely to be contained within the housing.

Additional objects and advantages of the present invention may become apparent upon referring to the preferred and alternative embodiments of the present invention as illustrated in the drawings and described in the following written description.

DETAILED DESCRIPTION OF PREFERRED AND ALTERNATIVE EMBODIMENTS

Figure 1:
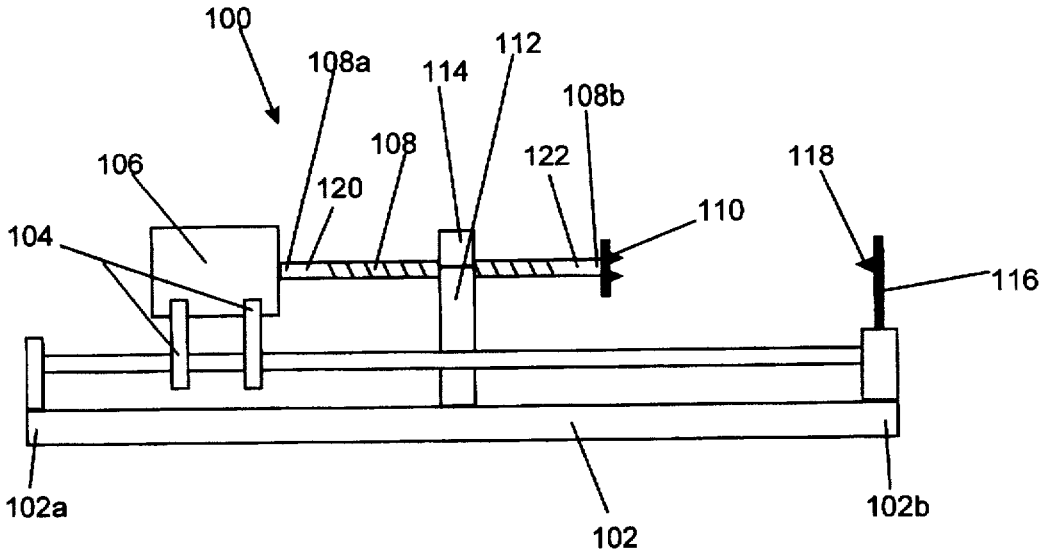
FIG. 1 is a side view of a spiral potato slicer according to the present invention.
Figure 2:
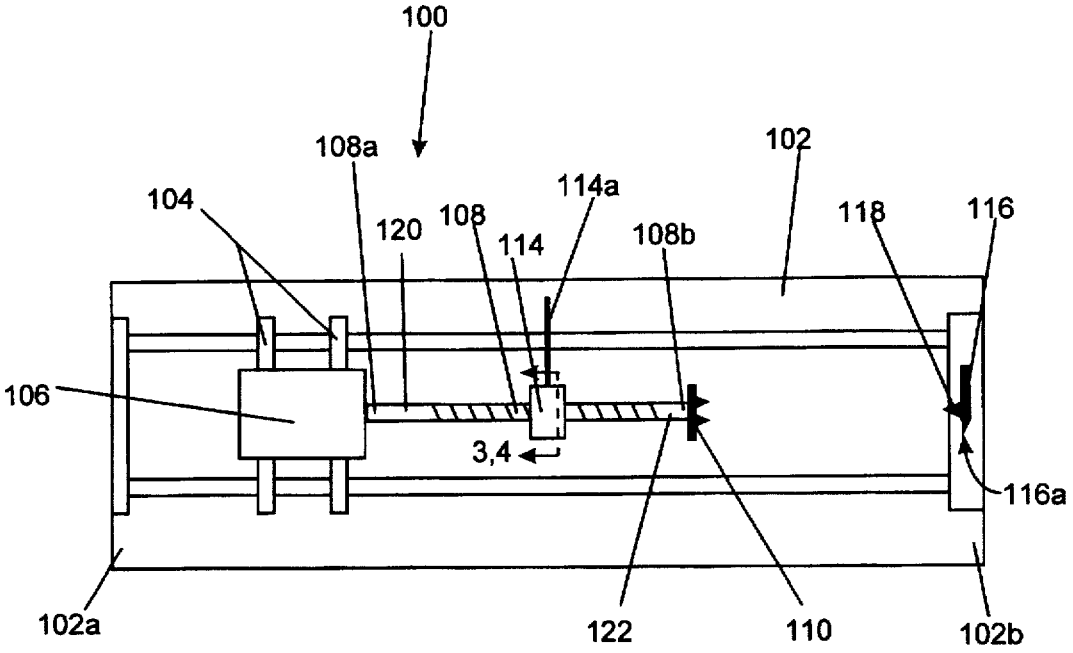
FIG. 2 is a top view of a spiral potato slicer according to the present invention.

FIGS. 1 and 2 are side and top views, respectively, of a preferred embodiment of a spiral potato slicer 100 according to the present invention, comprising: a base 102 having a first end 102*a* and a second end 102*b*; a carriage 104; a motor 106; a threaded shaft 108 having a first end 108*a* and a second end 108*b*; prongs 110; a shaft support 112; a shaft-engaging lever 114 having a handle 114*a*; a cutting blade 116; and a pin 118. Carriage 104 is supported on base 102 and may undergo guided linear longitudinal motion along base 102. Motor 106 is mounted on carriage 104. Threaded shaft 108 is positioned parallel to the direction of motion of carriage 104 and is connected at first end 108*a* to motor 106 and rotated by motor 106. Cutting blade 116 is mounted on base 102 near second end 102*b* of base 102, has a cutting edge 116*a* extending radially from an axis substantially defined by shaft 108, and has a pin 118 mounted thereon positioned substantially coaxially with and extending toward second end 108*b* of shaft 108. Shaft 108 is supported by shaft support 112, and threadedly engaged by shaft-engaging lever 114.

Figure 3:
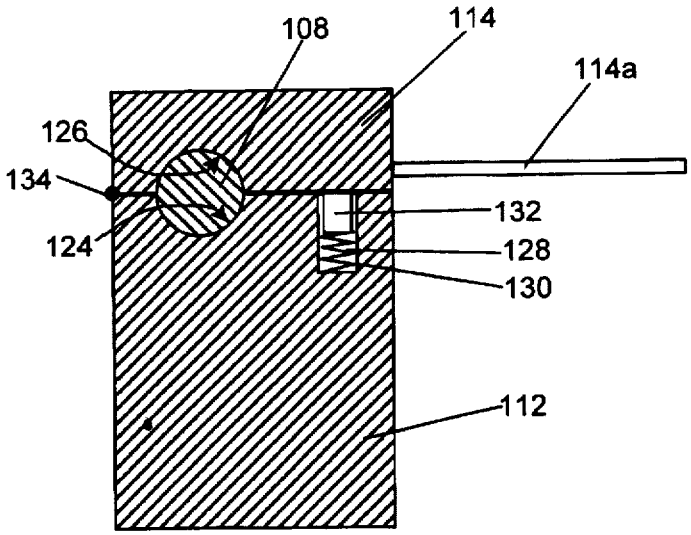
FIG. 3 is a detailed cross sectional view of threaded shaft support and engaging means showing the threaded shaft engaged.
Figure 4:
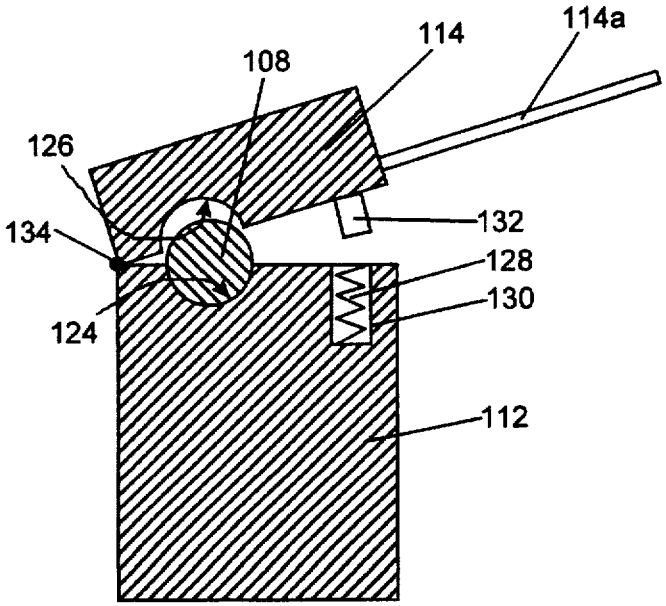
FIG. 4 is a detailed cross sectional view of threaded shaft support and engaging means showing the threaded shaft disengaged.
Figure 5:
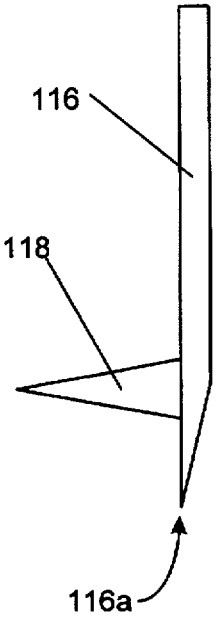
FIG. 5 is a detailed top view of the cutting blade and potato engaging pin.

FIGS. 3 and 4 are cross sectional views of shaft 108, shaft support 112, and lever 114 with handle 114*a* when lever 114 is engaged with and disengaged from, respectively, shaft 108. Shaft support 112 has a substantially smooth (i.e., not threaded) half cylindrical depression 124, thereby allowing free rotation of shaft 108 within cylindrical depression 124 and/or free sliding of shaft 108 through cylindrical depression 124 while providing support for shaft 108. Lever 114 may be pivotably attached to shaft support 112 by hinge 134. Lever 114 has a threaded half cylindrical depression 126 for engaging threaded shaft 108, and has a handle 114*a*. Lowering handle 114*a* and lever 114 (as in FIG. 3) engages threaded cylindrical depression 126 with threaded shaft 108. Raising handle 114*a* and lever 114 disengages threaded depression 126 from shaft 108. When lever 114 engages threaded shaft 108 (as in FIG. 3), rotation of threaded shaft 108 by motor 106 in a forward direction results in longitudinal motion of shaft 108, motor 106, and carriage 104 toward cutting blade 116. Disengagement of lever 114 and shaft 108 terminates longitudinal motion of shaft 108, motor 106, and carriage 104. Shaft support 112, lever 114, and depressions 124 and 126 therefore provide means for supporting and threadedly engaging shaft 108.

A potato to be sliced is placed by a user on prongs 110 on second end 108*b* of shaft 108, thereby nonrotatably engaging shaft 108 with the potato. Prongs 110 therefore provide means for nonrotatably engaging a first end of the potato with second end 108*b* of shaft 108. Without departing from inventive concepts disclosed and/or claimed herein, any functionally equivalent means may be employed at the end of threaded shaft 108 to nonrotatably engage a potato to be sliced. With lever 114 disengaged from shaft 108, carriage 104, motor 106, shaft 108, and the potato may be slid toward cutting blade 116 until pin 118 pierces the end of the potato opposite prongs 110. Pin 118 thereby rotatably engages the potato, so that the potato may freely rotate on pin 118 as shaft 108 is rotated. Pin 118 therefore provides means for rotatably engaging a second end of the potato at cutting blade 116. Without departing from inventive concepts disclosed and/or claimed herein, any functionally equivalent means may be employed on cutting blade 116 to rotatably engage the potato to be sliced. When lever 114 engages shaft 108 and shaft 108 is rotated by motor 106, the potato is rotated and advanced into cutting blade 116, thereby producing thin substantially continuous spiral potato slices. If cut sufficiently thinly, the spiral potato slices thus produced yield upon deep frying spiral potato chips. The thickness of the chip is determined by the pitch of the threads of shaft 108. In a preferred embodiment of the present invention, the pitch of shaft 108 is greater than about ten threads per inch, thereby producing potato slices less than about 0.1 inches in thickness which yield potato chips upon deep frying. This is in contrast to the devices disclosed in the patents cited hereinabove, which produce much thicker potato slices which yield fries upon deep frying.

In order to minimize the likelihood of damage to the potato slicer or injury to a user, advancement of prongs 110 into cutting blade 116 and/or pin 118 should be prevented. In a preferred embodiment of the present invention, threaded shaft 108 comprises a stripped segment 120 positioned along shaft 108 so that as shaft 108 advances toward cutting blade 116, stripped segment 120 reaches lever 114 before prongs 110 reach cutting blade 116 or pin 118. The stripped segment 120 does not engage lever 114, thereby limiting longitudinal motion of shaft 108, motor 106, and carriage 104 toward cutting blade 116, even if motor 106 continues to rotate. In an alternative embodiment of the present invention, motor 106 may be reversible, thereby allowing motion of shaft 108, motor 106, and carriage 104 away from cutting blade 116 as shaft 108 is rotated in a reverse direction with shaft 108 engaged with lever 114. A second stripped segment 122 may be positioned on shaft 108 so that stripped segment 122 reaches lever 114 before prongs 110 reach shaft support 112 or lever 114. The stripped segment 122 does not engage lever 114, thereby limiting longitudinal motion of shaft 108, motor 106, and carriage 104 away from cutting blade 116, even if motor 106 continues to rotate.

Another safety feature of the present invention is shown in FIGS. 3 and 4. In a preferred embodiment of the present invention, lever 114 further comprises a protrusion 132 which is received by a mating hole 130 in shaft support 112 when lever 114 engages shaft 108. A spring 128 within hole 130 forces lever 114 up and out of engagement with shaft 108 in the absence of a downward force applied to lever 114 by a user. Likewise, a downward force on lever 114 must be applied by a user in order to compress spring 128 and achieve engagement of lever 114 and shaft 108. This insures that longitudinal motion of shaft 108, motor 106, and carriage 104 may only occur when a force is applied by a user, thereby reducing the likelihood of accidental or unintentional longitudinal motion of the potato slicer. In an alternative embodiment of the present invention, any functionally equivalent means may be employed in which a force applied by a user is required to achieve and maintain threaded engagement of shaft 108. For example, a lever similar to that shown in FIGS. 3 and 4 may be employed below the threaded shaft, so that in the absence of a force applied by a user, gravity causes the lever to fall away from the shaft, thereby disengaging the shaft. A force applied by the user is required to hold the lever up to achieve and maintain engagement of the shaft.

In a preferred embodiment of the present invention, motor 106 is a variable speed motor. Variable speed control allows a user to begin a slicing operation slowly and to ascertain that a potato being sliced is properly engaged within the potato slicer before increasing the motor speed (and therefore potato rotation speed). In a preferred embodiment of the present invention, a foot pedal (not shown in the Figures) may be provided for controlling the speed of motor 106, thereby freeing both of a user's hands for engaging a potato within the potato slicer and engaging shaft 108 with lever 114.

In a preferred embodiment of the present invention a housing (not shown in the Figures) may be provided which substantially encloses potato slicer 100. Without departing from inventive concepts disclosed and/or claimed herein, the housing may assume any of a wide variety of forms which substantially enclose the potato slicer and allow insertion of a potato into the potato slicer and engagement of the threaded shaft. In a preferred embodiment of the present invention, the housing may be provided with an opening large enough to allow insertion of a potato and engagement of the potato within potato slicer 100 by a user. The opening may be made small enough that the housing substantially contains most flying chunks of potato which may arise if the potato becomes disengaged from the potato slicer during operation. Lever 114 may extend out of the housing through a slot provided therefor to allow engagement of shaft 108. In an alternative embodiment of the present invention, the opening may be provided with a cover which may be opened for potato insertion and closed during potato slicing. In an alternative embodiment of the present invention, all or part of the housing may be movable and/or removable to allow insertion of a potato to be sliced. Further, the housing and/or cover may be coupled with the means for engaging the threaded shaft so that the threaded shaft may only be engaged when the potato slicer is completely enclosed. In this way inadvertent advancement of the rotating shaft and prongs into a user's hands is effectively prevented.

The present invention has been set forth in the form of its preferred and alternative embodiments. It is nevertheless intended that modifications to the disclosed spiral potato slicer methods and apparatus may be made without departing from inventive concepts disclosed and/or claimed herein. be provided with a cover which may be opened for potato insertion and closed during potato slicing. In an alternative embodiment of the present invention, all or part of the housing may be movable and/or removable to allow insertion of a potato to be sliced. Further, the housing and/or cover may be coupled with the means for engaging the threaded shaft so that the threaded shaft may only be engaged when the potato slicer is completely enclosed. In this way inadvertent advancement of the rotating shaft and prongs into a user's hands is effectively prevented.

The present invention has been set forth in the form of its preferred and alternative embodiments. It is nevertheless intended that modifications to the disclosed spiral potato slicer methods and apparatus may be made without departing from inventive concepts disclosed and/or claimed herein.

What is claimed is:

1. A potato slicer, comprising:

a base having a first end and a second end;

a carriage;

means for supporting said carriage on said base:

means for providing guided linear longitudinal motion of said carriage along said base;

a motor mounted on said carriage;

a longitudinal threaded shaft having a first end and a second end, the first end being nearer to the first end of said base and the second end being nearer to the second end of said base, said shaft being connected at the first end of said shaft to said motor whereby action of said motor rotates said shaft, said shaft substantially defining a potato rotation axis;

means for nonrotatably engaging a first end of a potato with the second end of said shaft, whereby rotation of said shaft causes rotation of said potato about the potato rotation axis;

means for supporting and threadedly engaging said shaft, said supporting and engaging means being connected to said base and producing longitudinal motion of said potato, said shaft, said motor, and said carriage toward the second end of said base when said shaft is engaged and rotated in a forward direction;

a cutting blade having a cutting edge and being connected to said base near the second end of said base, said cutting blade being substantially perpendicular to said potato rotation axis with the cutting edge positioned radially with respect to said potato rotation axis; and means for rotatably engaging a second end of said potato with said cutting blade, wherein said threaded shaft has a pitch of greater than about ten threads per inch.

2. A potato slicer as recited in claim 1, wherein:

said means for nonrotatably engaging the first end of said potato comprises at least two prongs connected to the second end of said shaft; and said means for rotatably engaging the second end of said potato comprises a pin connected to said cutting blade, directed toward the first end of said base, and positioned substantially on the potato rotation axis.

3. A potato slicer as recited in claim 1, wherein said means for supporting and threadedly engaging said shaft comprises:

a shaft support with an unthreaded half cylindrical depression for receiving said shaft wherein said shaft may freely rotate within said depression and said shaft may freely move longitudinally through said depression; and a lever pivotably connected to said shaft support with a threaded half cylindrical depression for threadedly engaging said shaft, said lever engaging said shaft when in a first lever position and being disengaged from said shaft when in a second lever position, said lever having a handle connected thereto.

4. A potato slicer as recited in claim 3, further comprising a spring connected to said shaft support for opposing movement of said lever into the first lever position by a force applied by a user of said potato slicer, thereby maintaining said lever in the second lever position when the force applied by the user of said potato slicer is absent.

5. A potato slicer as recited in claim 1, wherein a segment of said threaded shaft near the first end of said threaded shaft is stripped of threads, thereby limiting longitudinal motion of said shaft, said motor, and said carriage toward the second end of said base and preventing collision of said means for nonrotatably engaging said potato on the second end of said shaft with said cutting blade.

6. A potato slicer as recited in claim 1, wherein said motor is reversible and engagement of said shaft and rotation of said shaft by said motor in a reverse direction produces longitudinal motion of said shaft, said motor, and said carriage toward the first end of said base.

7. A potato slicer as recited in claim 6, wherein a segment of said threaded shaft near the second end of said threaded shaft is stripped of threads, thereby limiting longitudinal motion of said shaft, said motor, and said carriage toward the first end of said base and preventing collision of said means for nonrotatably engaging said potato on the second end of said shaft with the shaft supporting and engaging means.

8. A potato slicer as recited in claim 1, wherein said motor is a variable speed motor.

9. A potato slicer as recited in claim 2:

wherein said means for supporting and threadedly engaging said shaft comprises a shaft support with an unthreaded half cylindrical depression for receiving said shaft wherein said shaft may freely rotate within said depression and said shaft may freely move longitudinally through said depression, and a lever pivotably connected to said shaft support with a threaded half cylindrical depression for threadedly engaging said shaft;

wherein said lever engages said shaft when in a first lever position, is disengaged from said shaft when in a second lever position, and has a handle connected thereto;

wherein a force applied by a user of said potato slicer is required to maintain said lever in the first lever position, further comprising a spring connected to said shaft support for opposing the force applied by the user and maintaining said lever in the second lever position when the force applied by the user of said potato slicer is absent;

a segment of said threaded shaft near the first end of said threaded shaft is stripped of threads, thereby limiting longitudinal motion of said shaft, said motor, and said carriage toward the second end of said base and preventing collision of said prongs on the second end of said shaft with the cutting blade;

said motor is reversible and rotation of said shaft by said motor in a reverse direction produces longitudinal motion of said shaft, said motor, and said carriage toward the first end of said base; and said motor is a variable speed motor.

10. A method for slicing a potato, comprising:

positioning said potato between an end of a rotatable threaded shaft and a fixed pin positioned substantially coaxially with said shaft, said threaded shaft having a pitch of greater than or substantially equal to ten threads per inch;

nonrotatably mounting said potato onto the end of said rotatable threaded shaft;

rotatably mounting said potato onto said fixed pin; threadedly engaging said shaft; and rotating said shaft with a motor in a forward direction, thereby producing longitudinal motion of said potato, said shaft, and said motor toward a radially positioned cutting blade;

wherein combined rotation and longitudinal motion of said potato toward said cutting blade produces thin, substantially continuous spiral potato slices which yield spiral potato chips upon deep frying.

11. A method for slicing a potato as recited in claim 10, wherein a force must be applied by a user of said potato slicing method to maintain threaded engagement of said shaft.

12. A method for slicing a potato as recited in claim 10, wherein said motor comprises a variable speed motor.

13. A method for slicing a potato as recited in claim 12, wherein said motor is controlled by a foot pedal.

14. An improved potato slicer of a time comprising:

a base, a carriage, means for supporting the carriage on the base, means for providing guided linear motion of the carriage along the base, a motor, a longitudinal threaded shaft connected at a first end of the shaft to the motor and rotated by the motor, means for nonrotatably engaging a potato with a second end of the shaft, means for supporting the threaded shaft on the base, means for threadedly engaging the shaft, a radial cutting blade connected to an end of the base nearer to the second end of the shaft, and means for rotatable engaging a second end of the potato with the cutting blade, wherein rotation of the threaded shaft in a forward direction produces simultaneous rotation of the potato and translation of the potato toward the cutting blade thereby slicing the potato into substantially continuous spiral slices, wherein the improvement comprises providing the threaded shaft with a pitch of greater than about ten threads per inch, whereby the spiral potato slices are less than about 0.1 inch in thickness and thereby yield spiral potato chips upon deep frying.

* * * * *